US010986701B2

(12) United States Patent
Park et al.

(10) Patent No.: US 10,986,701 B2
(45) Date of Patent: Apr. 20, 2021

(54) MOVABLE CORE INDUCTION HEATING APPARATUS

(71) Applicant: Supercoil Co., Ltd., Gyeongsangnam-do (KR)

(72) Inventors: Min Won Park, Gyeongsangnam-do (KR); In Keun Yu, Gyeongsangnam-do (KR); Jong Ho Choi, Gyeongsangnam-do (KR)

(73) Assignee: INDUSTRY-ACADEMIC COOPERATION FOUNDATION CHANGWON NATIONAL UNIVERSITY, Gyeongsangnam-Do (KR)

( * ) Notice: Subject to any disclaimer, the term of this patent is extended or adjusted under 35 U.S.C. 154(b) by 376 days.

(21) Appl. No.: 15/547,822

(22) PCT Filed: Nov. 10, 2015

(86) PCT No.: PCT/KR2015/012074
§ 371 (c)(1),
(2) Date: Aug. 1, 2017

(87) PCT Pub. No.: WO2016/143975
PCT Pub. Date: Sep. 15, 2016

(65) Prior Publication Data

US 2018/0014364 A1 Jan. 11, 2018

(30) Foreign Application Priority Data

Mar. 11, 2015 (KR) ..... 10-2015-0033923

(51) Int. Cl.
*H05B 6/10* (2006.01)
*H01F 6/06* (2006.01)
(Continued)

(52) U.S. Cl.
CPC ..... *H05B 6/102* (2013.01); *H01F 6/06* (2013.01); *H05B 6/362* (2013.01); *H05B 6/365* (2013.01); *H05B 6/44* (2013.01)

(58) Field of Classification Search
CPC ..... H05B 6/109; H05B 6/102; H05B 6/10; H05B 6/44; H05B 6/36; H05B 6/06;
(Continued)

(56) References Cited

U.S. PATENT DOCUMENTS 4,026,040 A * 5/1977 Valentine ..... G09B 23/182 434/314
4,595,898 A * 6/1986 Shiraki ..... H01F 6/06 174/125.1
(Continued)

FOREIGN PATENT DOCUMENTS

JP 2009218017 9/2009
JP 2009218017 A * 9/2009
(Continued)

OTHER PUBLICATIONS

Dawson's Recycling and disposal, "Ferrous VS Non Ferrous Metals" Jul. 18, 2013, https://www.dawsonrecyclinganddisposalinc.com (Year: 2013).*
(Continued)

*Primary Examiner* — Phuong T Nguyen
*Assistant Examiner* — Yeong Juen Thong
(74) *Attorney, Agent, or Firm* — Porzio Bromberg & Newman P.C.

(57) ABSTRACT

The present invention relates to a superconducting magnet apparatus using movable iron core and induction heating apparatus thereof. The superconducting magnet structure is composed by including a pair of superconducting magnets and a pair of movable iron cores which are symmetrically located with respect to the heating target product located
(Continued)

between the superconducting magnets and a part of which move through the cutouts of the superconducting magnets. And the distance from the superconducting magnets is adjusted by moving the movable iron cores. Further, the present invention manufactures an induction heating apparatus by using the superconducting magnet structure.

5 Claims, 5 Drawing Sheets

(51) Int. Cl.
*H05B 6/36* (2006.01)
*H05B 6/44* (2006.01)

(58) Field of Classification Search
CPC ..... H05B 6/365; H05B 6/362; H05B 6/106; B29B 13/023; B21D 26/14; B21D 5/00; B29C 51/42; B29C 35/041; B29C 35/045; B29C 2035/0811; B29C 2035/0822; B29C 2035/0838; H01F 6/06
USPC ..... 219/600, 652
See application file for complete search history.

(56) References Cited

U.S. PATENT DOCUMENTS 5,306,701 A * 4/1994 Israelsson ..... H01F 6/06 29/599
5,349,921 A * 9/1994 Barraclough ..... C30B 15/305 117/13
7,102,353 B1 * 9/2006 Damadian ..... G01R 33/3815 324/318
9,667,117 B2 * 5/2017 Ben David ..... H02K 7/025
2004/0162480 A1 * 8/2004 Satragno ..... A61B 5/0555 600/415
2006/0225437 A1 * 10/2006 Kazami ..... F25B 9/14 62/51.1
2009/0255923 A1 * 10/2009 Buehrer ..... H05B 6/145 219/635
2011/0319270 A1 * 12/2011 Mueller ..... F27B 14/06 505/163
2012/0080424 A1 * 4/2012 Wiezoreck ..... H05B 6/06 219/652
2014/0269151 A1 * 9/2014 Kisner ..... B01F 11/0291 366/116
2015/0162799 A1 * 6/2015 Ilan ..... H02K 7/025 310/74
2015/0213930 A1 * 7/2015 Hahn ..... H01F 6/06 335/216
2015/0332812 A1 * 11/2015 Takemoto ..... H01F 6/06 505/230

FOREIGN PATENT DOCUMENTS

JP 2010015695 * 1/2010
JP 2010015695 A * 1/2010
KR 101468312 * 12/2014
KR 101468312 B1 * 12/2014

OTHER PUBLICATIONS

International Search Report, PCT/KR2015/012074 dated Feb. 19, 2016.

* cited by examiner

MOVABLE CORE INDUCTION HEATING APPARATUS

TECHNICAL FIELD

The present invention relates to induction heating apparatus, and more particularly, relates to superconducting magnet apparatus using movable iron core, and induction heating apparatus thereof that enables a heating target product to be heated to a maximum power through moving the movable iron core according to the size of the heating target product by applying a superconducting magnet apparatus using movable iron core.

BACKGROUND

A superconductor is an element whose electrical resistance becomes '0' at an extremely low temperature. It has already been used in a variety of application fields because it offers advantages of high magnetic field, low loss, and miniaturization compared to conventional copper (cu) conductors.

Superconducting magnets are magnets made from these superconductors. Superconducting magnets are used in MRI, NMR, particle accelerators, and magnetic separators to improve efficiency and performance. In addition, application technology is continuously explored throughout the industry such as power cable, superconducting transformer, and superconducting motor. Also, it is applied to the steel industry as one of the application fields. Particularly, research and development of a large capacity induction heating apparatus is actively performed.

The heating method for the induction heating device can be classified into AC induction heating and DC induction heating.

AC induction heating is a method of applying an AC current to a copper magnet to generate a time-varying magnetic field. However, since AC induction heating uses copper magnets, the total system energy efficiency is only about 50-60% due to heat generated by the resistance of the copper magnet. Therefore, superconducting magnets are used instead of the copper magnets. This is to improve energy conversion efficiency.

However, there is a disadvantage in that magnetization loss occurs in the superconducting wire used for a material of the superconducting magnet. This means that cooling is necessary to maintain the superconducting state in a cryogenic operating environment, and therefore, there is a problem in that the operation cost is increased together with the facility cost of the cooling device.

Meanwhile, DC induction heating is a method of applying a DC current to a superconducting magnet to generate a uniform magnetic field and of forcing the product to rotate in the magnetic field by a motor. Such DC induction heating has the advantage that the overall system efficiency of the induction heating apparatus can be improved by 90% or more without causing heat loss of the superconducting magnet by using the DC current. Further, since the energy is transmitted in proportion to the square of the magnetic field generated by the superconducting magnet, the heating time for the heating target product can be shortened and the productivity can be further improved.

Accordingly, the DC induction heating method is widely applied to induction heating apparatus, and the race track type superconducting magnet is widely used as a superconducting magnet for DC induction heating method.

FIG. 1 is a drawing illustrating a superconductive coil of such race track type.

Referring to FIG. 1, the heating target product 1 is located in the center, and the superconducting magnet 10 of race track type is located on the side of the heating target product 1. The superconducting magnets 10 are provided in a pair so as to be symmetrical to each other on the side of the heating target product 1.

Such heating target product 1 and the superconducting magnets 10 rotate the heating target product 1 and acquire magnetic field by supplying the DC current to the superconducting magnets 10.

However, as is well known, the superconducting wire used as the material for the superconducting magnet 10 is very expensive. Therefore, the manufacturing cost of the induction heating apparatus is inevitably increased as much as the cost of purchasing the superconducting wire. Thereby, a method of manufacturing an induction heating apparatus having a desired capacity even if the superconducting wire is used less under the same condition is being sought after. Accordingly, there has been proposed a method of generating large magnetic fields even when the shape of the superconducting magnet 10 of the race track type is small.

However, even if they are manufactured in the same size as the race track type superconducting magnets 10, it is possible to reduce the manufacturing cost of the induction heating apparatus as well as the cost of purchasing the superconducting wire, if the more magnetic field can be generated. Namely, there has been a great demand for induction hearing apparatus that can provide a desired capacity while using less expensive superconducting wire.

SUMMARY OF INVENTION

Technical Tasks

Therefore, the present invention is directed to providing a superconducting magnet apparatus using a moveable iron core that can generate a larger magnetic field of a heating target product by applying a movable iron core to a superconducting magnet.

Another object of the present invention is to provide a movable induction heating apparatus manufactured by applying the superconducting magnet apparatus so that the heating target product can be heated with maximum power even if the external sizes of the heating target products are different.

Namely, the present invention enables a reduction in the cost of purchasing the superconducting wire used for a semiconducting magnet by providing an induction heating apparatus of desired capacity by using less numbers of expensive superconducting magnets.

Solution to Problem

According to an aspect of the present invention, the present invention provides a superconducting magnet apparatus using moveable iron core which includes a pair of superconducting magnets; and a pair of movable iron cores that are located symmetrically with respect to a heating target product positioned between the superconducting magnets and partly move through the cut portion of the superconducting magnets, wherein the moveable iron core controls a distance to the superconducting magnets by moving the moveable iron core.

The superconducting magnets have a circular shape, a race track shape.

The center magnetic field of the heating target product is 1.18 (T) when an operation current is 80% of the critical current of the superconducting magnet.

The superconducting magnet structure using the moveable iron core is characterized in that a magnetic field value of at least twice that of the superconducting magnet structure in which the movable iron core is not provided is generated in the heating target product.

According to another aspect of the present invention, the present invention provides an induction heating apparatus including a pair of superconducting magnets in which a moveable iron core is respectively equipped; a heating target product located between the superconducting magnets; and an operation unit that rotates the heating target product.

The induction heating apparatus further includes a cryogenic freezer in which the superconducting magnets is mounted inside; and a replacement type fixture for positioning the heating target products having different outer sizes between the pair of superconducting magnets, wherein the cryogenic freezer is composed of an inner cryostat and an outer cryostat.

The distance between the superconducting magnets and the heating target product is 50 mm.

The heating power applied to the heating target product is four times or more than that of the induction heating apparatus to which the superconducting magnet structure to which the movable iron core is not provided is applied.

Effects of Invention

According to the superconducting magnet structure using the movable iron core and the induction heating apparatus thereof according to an example of the present invention, the following effects can be obtained.

In the present invention, a superconducting magnet using a movable iron core is applied to an induction heating apparatus. Accordingly, the movable iron core can be moved according to the external size of the heating target product, so that the distance between the heating target product and the movable iron core can always be maintained at the optimum distance. As a result, the heating target product always generates the highest magnetic field value, the product can be heated by improving the heating power for the heating target product. That is, it is possible to generate a magnetic field twice or more than the superconducting magnet structure of the conventional race track shape (for example, the magnet structure in which the movable iron core is not provided).

Therefore, the example of the present invention can manufacture an induction heating apparatus having a capacity higher than that of the conventional one even when the superconducting wire is used in a small amount, thereby providing an advantage that the purchase cost of the superconducting wire can be reduced and that the induction heating apparatus can be manufactured at a lower cost.

METHOD FOR CARRYING OUT THE INVENTION

The present invention can adjust the distance between the heating target product and the movable iron core to be always at the optimum distance by applying the superconducting magnet structure using the movable iron core and the superconducting magnet structure to the induction heating apparatus. Therefore, the heating electric power for the heating target product can be further improved as compared with the prior art while maintaining the highest magnetic field value at all times.

And the induction heating apparatus according to the present invention refers to a direct current (DC) induction heating apparatus. The induction heating device refers to a device that heats a heating target product to be heated to a desired temperature in a uniform magnetic field. The uniform magnetic field can be obtained when a DC current is supplied to the superconducting magnet, and the larger the magnetic field generated in the superconducting magnet, the larger the energy transfer becomes possible. Of course, the magnetic field increases in proportion to the current flowing through the superconducting magnet, the number of turns, and the number of coils and decreases in inverse proportion to the distance to the heating target product. Therefore, as the distance between the superconducting magnet and the heating target product becomes closer, a larger magnetic field can be obtained and the transferrable energy becomes larger. Accordingly, the present invention proposes a superconducting magnet using a movable iron core and an induction heating apparatus thereof so that the heating target product can always be heated at the maximum electric power while maintaining the highest magnetic field value.

Further, in the present invention, the shape of the superconducting magnet is not limited to the shape of the race track, but a superconducting magnet having a difference shape such as a circular shape can be applied.

Hereinafter, an exemplary embodiment of semiconducting magnet apparatus using movable iron core and induction heating apparatus thereof according to the present invention will be described in detail with reference to the accompanying drawings.

Figure 1:
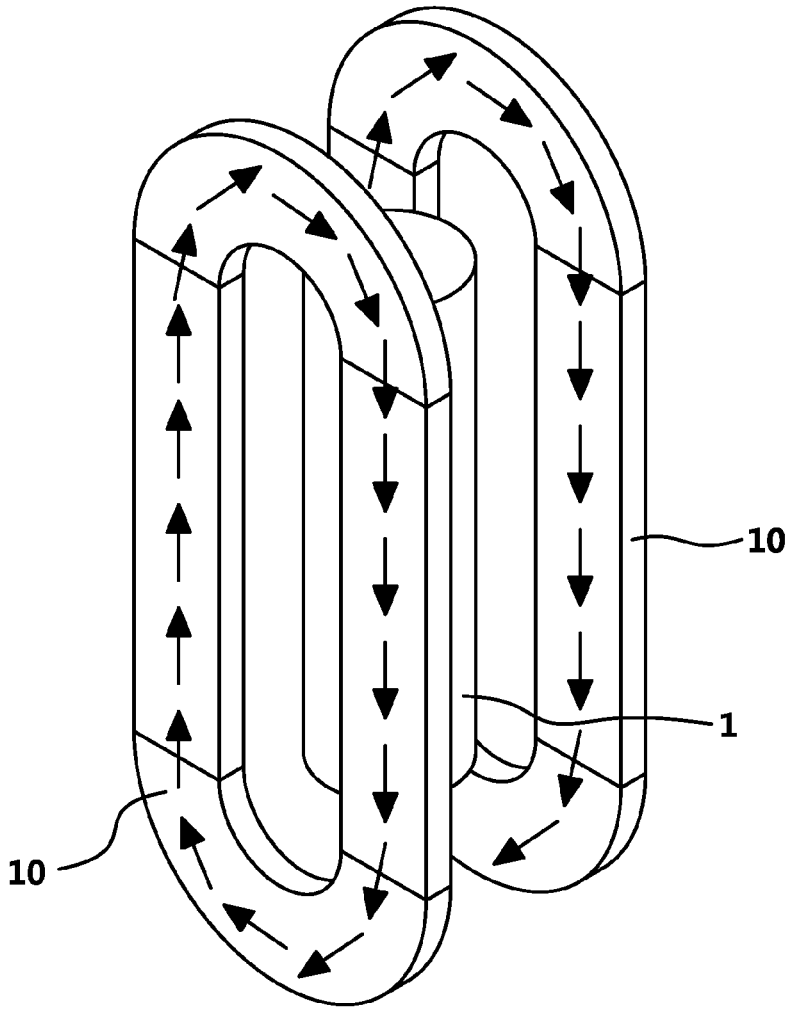
FIG. 1 is a drawing illustrating a superconducting magnet of general race track type.
Figure 2:
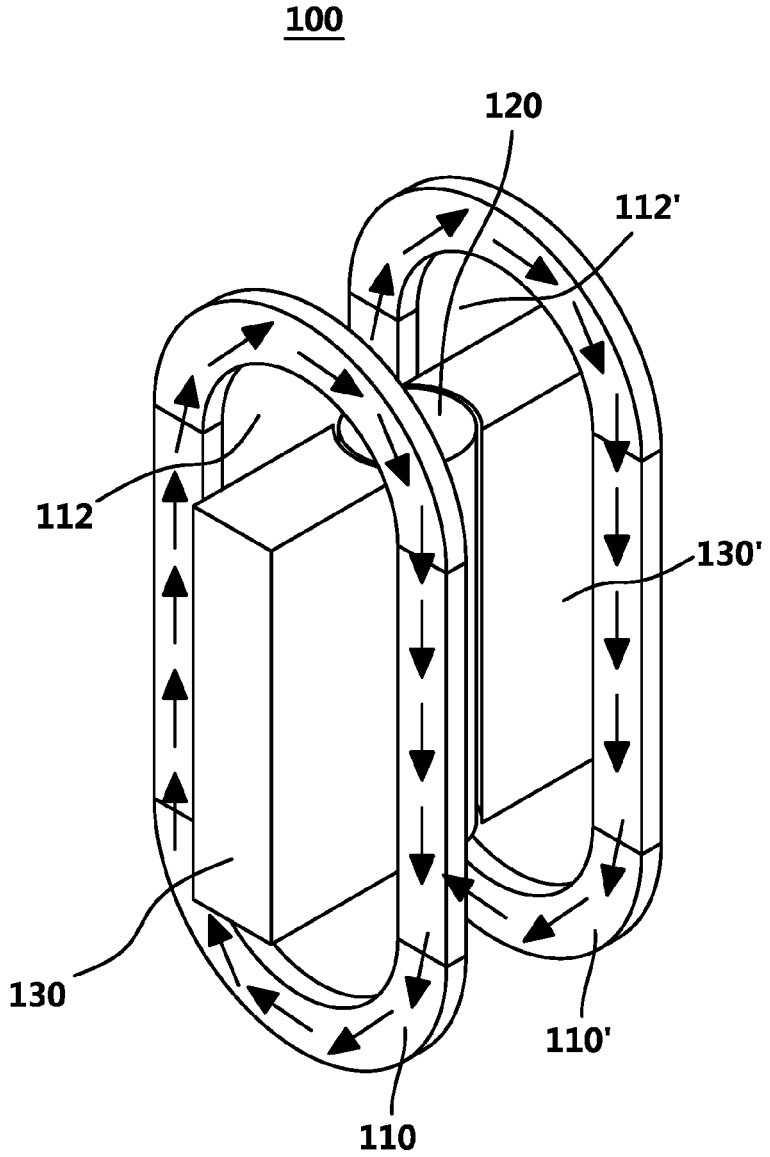
FIG. 2 is a drawing illustrating a superconducting magnet in which a movable iron core is applied according to an example.

FIG. 2 is a drawing illustrating a superconducting magnet in which a movable iron core is applied according to an example.

To explain, in the superconducting magnet structure 100, a pair of superconducting magnets 110 and 110' are arranged. The pair of superconducting magnets 110 and 110' have a shape of race track type. Of course, as for the type of superconducting magnet, as described above, a superconducting magnet formed in a circle shape other than a race track shape can be applied. Hereinafter, the pair of superconducting magnets will be explained as a first semiconducting magnet 110 and the second superconducting magnet 110'.

The first superconducting magnet 110 and the second superconducting magnet 110' are spaced apart from each other.

A heating target product 120 is located between the first superconducting magnet 110 and the second superconducting magnet 110'. The heating target product 120, a non-magnetic material, may be aluminum, copper, or the like.

According to an example, the heating target product 120 is formed in a cylindrical shape and may be referred to as a metal billet.

The movable iron cores 130 and 130' are provided so as to be symmetrical with respect to the heating target product 120. The movable iron core is also provided as a pair and the first movable iron core 130 is disposed on the first superconducting magnet 110 and the second movable iron core 130' is disposed on the second superconducting magnet 110'. The first movable iron core 130 and the second superconducting iron core 130' are formed in the same shape and size as each other, and are formed as a hexahedron in the example. The first movable iron core 130 and the second movable iron core 130' are located symmetrically with respect to the heating target product 120 at the center. Also, the parts of the first movable iron core 130 and the second movable iron core 130' are positioned through the cutouts 112 and 112' of the first superconducting magnet 110 and the second superconducting magnet 110'. Although the first movable iron core 130 and the second movable iron core 130' are illustrated as in contact with the heating target product 120, since the first movable iron core 130 and the second movable iron core 130' are installed movably in one direction, the distance from the heating target product 120 is adjusted. Preferably, the distance becomes a distance at which the heating target product 120 can always maintain the highest magnetic field value according to the external size of the heating target product 120.

Figure 3:
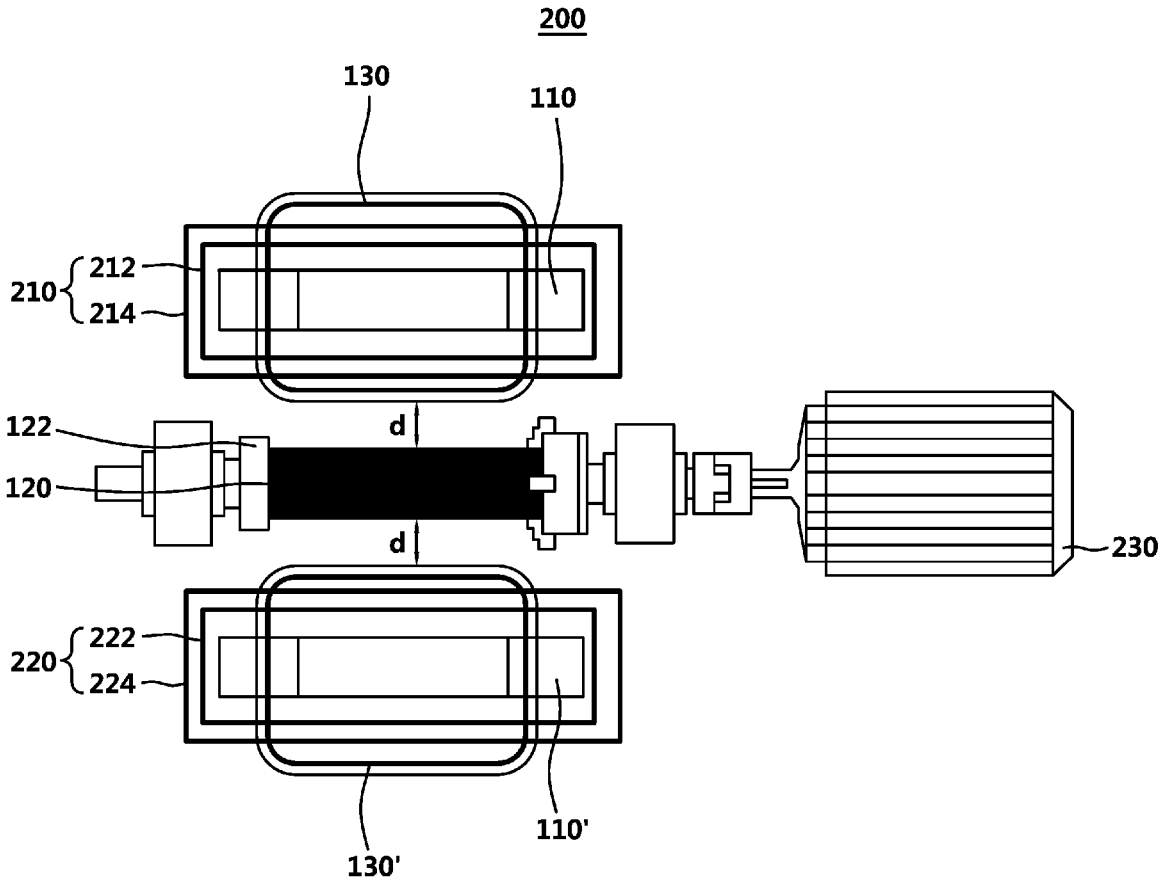
FIG. 3 is a floor plan illustrating an induction heating apparatus according to an example.

FIG. 3 is a floor plan illustrating an induction heating apparatus according to an example.

In the induction heating apparatus 200, two cryogenic freezers 210 and 220 are provided symmetrically with respect to the heating target product in order to block heat intrusion from the outside. The cryogenic freezers 210 and 220 are provided to provide a minimum condition for maintaining the superconducting properties of the first superconducting magnet 110 and the second superconducting magnet 110' and, generally, it is a device for creating and maintaining a low temperature environment. For this purpose, each of the cryogenic freezers 201 and 220 includes a combination of an inner cryostat 212 and the outer cryostat 214 and 224.

The heating target product 120 is located between the cryogenic freezers 210 and 220.

And the heating target product 120 is connected to the motor shaft of the driving motor 230 at one side and rotated at a constant speed by driving of the driving motor 230. Of course, the heating target product 120 should be installed by a separate bracket 122 or so forth.

Further, the first movable core 130 and the second movable core 130' are located at a regular distance (d) from the heating target product 120. The first movable iron core 130 and the second movable core 130' have a structure that it is possible to move in one direction through the cutouts (112, refer to the FIG. 2) of the first superconducting magnet 110 and the second semiconducting magnet 110'. Therefore, it is possible to adjust the distance (d) from the heating target product 120 according to the size of the heating target product 120.

Figure 4A:
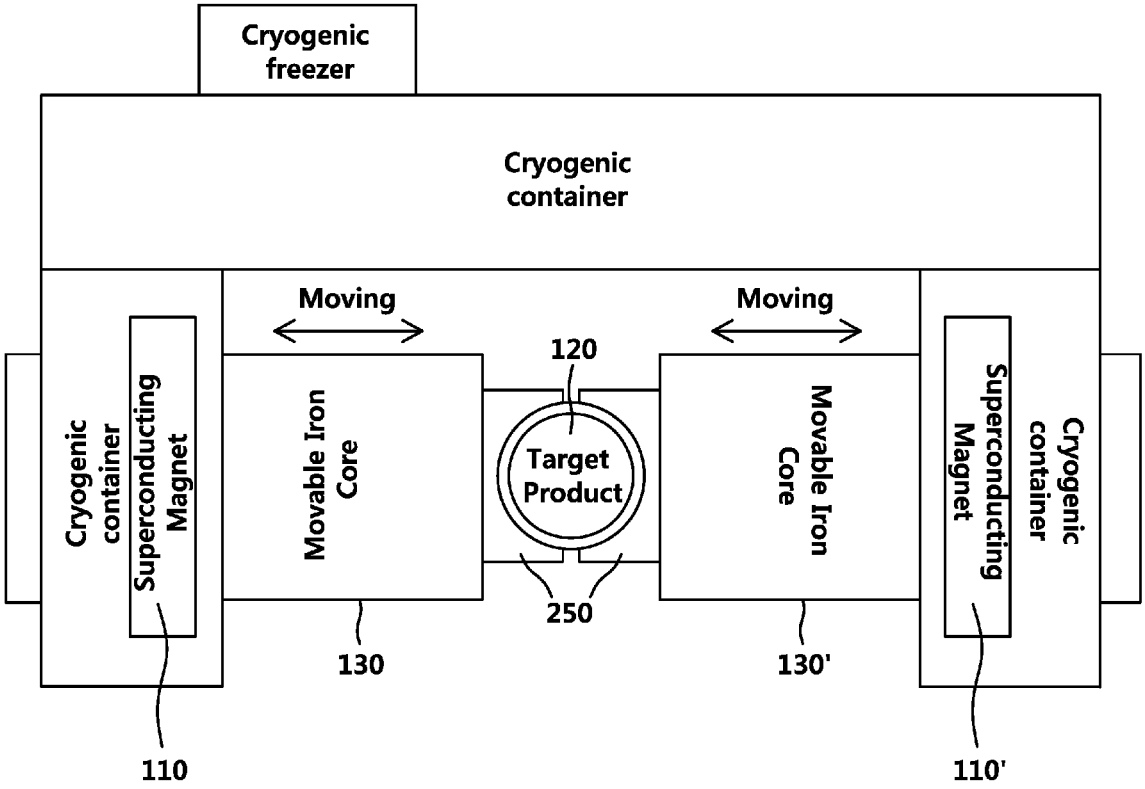
FIG. 4A and FIG. 4B are drawings showing examples of mounting on a replaceable fixture for a heating target product having different external sizes.
Figure 4B:
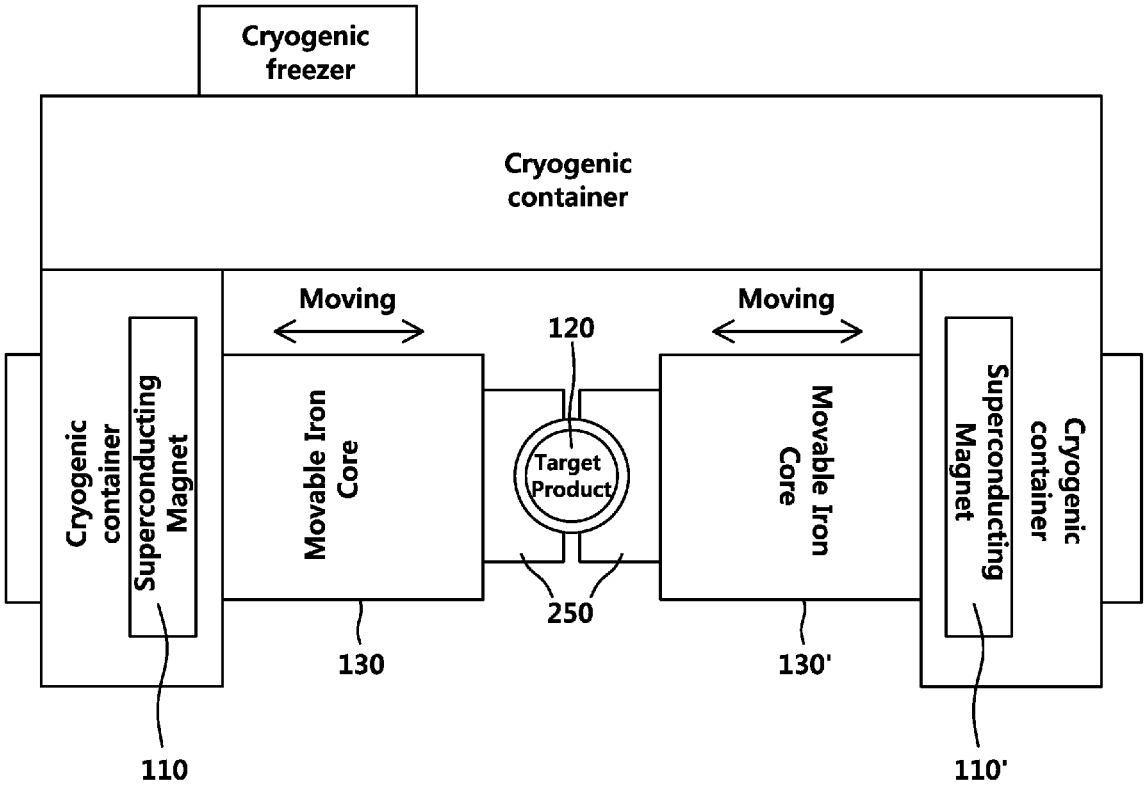

An example of installing the heating target product according to the external size of the heating target product 120 can be seen with reference to FIG. 4. FIG. 4A and FIG. 4B are drawings showing examples of mounting on a replaceable fixture for a heating target product having different external sizes.

Referring to the FIGS., it can be identified that a replaceable fixture 250 having different sizes is provided for installing the heating target product 120 according to the external size of the heating target product 120. And the first movable iron core 130 and the second movable iron core 130' are moved in the state where the heating target product 130 is mounted in the replaceable fixture 250 to adjust the separation distance. The distance becomes a distance at which the heating target product 120 can maintain the highest magnetic field value.

The performance of the induction heating apparatus provided with the movable iron core according to the present invention was compared with that of the conventional induction heating apparatus without the movable iron core.

As the experimental conditions, the superconducting magnets applied to the induction heating apparatus of the present invention and the conventional induction heating apparatus were designed to have the same size and usage amount. And the current which was 80% of the critical current of the superconducting magnet was regarded as the operation current. Further, the distance between the heating target product and the superconducting magnet was modelled as 50 mm.

As a result of the experiment, the center magnetic field of the conventional heating target product was 0.58(T), and the center magnetic field of the heating target product of the present invention was 1.18 (T) as shown in the below Table 1. Accordingly, when the same superconducting magnet length and outer size are applied, it can be seen that a magnetic field value twice as large is generated to the heating target product. This results in a result that the heating power can be improved four times or more.

TABLE 1

| Superconducting Magnet Structure | Maximum Magnetic Field [T] |
|---|---|
| The magnetic field value of the heating target product with superconducting magnets without movable iron core (Conventional Technology) | 0.58 |
| The magnetic field value of the heating target product with superconducting magnets with movable iron core (Present Invention) | 1.18 |

Like this, if an induction heating apparatus is manufacture with superconducting magnets with movable iron core, the heating target product can be heated at the maximum electric power as it is possible to maintain the distance between the heating target product and the superconducting magnets at the optimal distance.

As explained above, according to an example of the present invention, it is possible to secure a heating power about four times higher than that of the superconducting magnet without the movable iron core and to maintain the maximum output in all specifications regardless of the size of the heating target product by applying the movable iron core to the superconducting magnet. Furthermore, as the result of the experiment shows, it was confirmed that the magnetic field value of the heating target product was about twice or more higher than that of the conventional one under the same conditions. It can be objectively confirmed that the purchase cost of the superconducting wire can be reduced and the manufacturing cost of the induction heating apparatus can be reduced as well.

While this invention has been described in terms of its characterization, structure, and effects in connection with what is presently considered to be practical exemplary embodiments, it is to be understood that the invention is not limited to the disclosed embodiments. Furthermore, the described characterization, structure, and effects of the embodiments may be modified in various different ways by those skilled in the art. And these differences related to modifications and applications are intended to be included within the scope of the present disclosure as defined in what is claimed.

INDUSTRIAL APPLICABILITY

The present invention applied superconducting magnets with movable iron cores applied to the induction heating apparatus. Accordingly, it is possible to maintain the distance between the heating target product and the movable iron core at an optimal distance by moving the movable iron core according to the external size of the heating target products. As a result, since the heating target product can always generate the highest magnetic field value, the product can be heated by improving the heating power for the heating target product. Namely, it is possible to generate twice or more magnetic field compared to the superconducting magnet structure of the conventional race track shape (for instance, magnet structure without the movable iron core).

Therefore, an example of the present invention enables manufacturing of an induction heating apparatus with improved capacity while using less superconducting wires and thus can reduce the purchasing cost of the superconducting wire and manufacture an induction heating apparatus at a lower cost.

What is claimed is:

1. A superconducting magnet apparatus comprising:

a pair of superconducting magnets, each of the superconducting magnets have a circular shape or a race track shape which includes a cutout; and a pair of movable iron cores which are symmetrically located with respect to a heating target product located between the superconducting magnets, the heating target product being formed of a non-magnetic metal material, and a part of the movable iron cores move back and forth in a horizontal direction through the cutouts of the superconducting magnets and the heating target product is rotated by a driving motor, wherein each movable core and the superconducting magnet are moveable together in a horizontal direction with respect to the heating target product while the heating target product in rotation and a distance of the heating target product from the superconducting magnets is adjusted by moving the movable iron cores, wherein as the distance between the superconducting magnet and the heating target product becomes closer a magnetic field value of the heating target product is generated twice as large as that of a magnetic field value of the heating target product generated with a superconducting magnetic structure in which the moveable iron core is not provided.

2. The superconducting magnet apparatus of claim 1, wherein a center magnetic field of the heating target product is 1.18 (T) when an operation current is 80% of a critical current of the superconducting magnets.

3. An induction heating apparatus comprising: a pair of superconducting magnets in which movable iron cores are respectively provided, each of the superconducting magnets have a circular shape or a race track shape which includes a cutout, a part of the movable iron cores moves back and forth in a horizontal direction through the cutouts of the superconducting magnets; a heating target product located between the superconducting magnets, the heating target product being formed of a non-magnetic metal material, the moveable iron cores are symmetrically located with respect to the heating target product; and a motor that rotates the heating target product for heating the heating target product, wherein each moveable core and the superconducting magnet are moveable together in a horizontal direction with respect to the heating target product while the heating target product in rotation and a distance of the heating target product from the superconducting magnets is adjusted by moving the movable iron cores, wherein as the distance between the superconducting magnet and the heating target product becomes closer a heating power applied to the heating target product is four times or more higher than that of the induction heating apparatus to which the superconducting magnet structure in which the moveable iron core is not provided.

4. The induction heating apparatus of claim 3, further comprises a cryogenic freezer inside of which the superconducting magnets are equipped; and a replaceable fixture which allows the heating target product having different external sizes to be located between the pair of the superconducting magnets, wherein the cryogenic freezer is composed of an inner cryostat and an outer cryostat.

5. The induction heating apparatus of claim 4, wherein a distance between the superconducting magnets and the heating target product is 50 mm.

* * * * *